US006942897B2

(12) United States Patent
Joyce et al.

(10) Patent No.: US 6,942,897 B2
(45) Date of Patent: Sep. 13, 2005

(54) NANOPARTICLE BARRIER-COATED SUBSTRATE AND METHOD FOR MAKING THE SAME

(75) Inventors: Margaret K. Joyce, Kalamazoo, MI (US); Thomas W. Joyce, Kalamazoo, MI (US)

(73) Assignee: The Board of Trustees of Western Michigan University, Kalamazoo, MI (US)

( * ) Notice: Subject to any disclaimer, the term of this patent is extended or adjusted under 35 U.S.C. 154(b) by 185 days.

(21) Appl. No.: 10/369,298

(22) Filed: Feb. 19, 2003

(65) Prior Publication Data

US 2004/0161594 A1 Aug. 19, 2004

(51) Int. Cl.[7] ..... B05D 3/12
(52) U.S. Cl. ..... 427/365; 427/391
(58) Field of Search ..... 427/359, 361, 427/364, 365, 391

(56) References Cited

U.S. PATENT DOCUMENTS

| | | | | |
|---|---|---|---|---|
| 4,440,827 A | | 4/1984 | Miyamoto et al. | |
| 4,980,024 A | * | 12/1990 | Payne et al. | 162/135 |
| 5,466,493 A | * | 11/1995 | Mefford et al. | 427/384 |
| 5,874,134 A | | 2/1999 | Rao et al. | |
| 6,020,419 A | | 2/2000 | Bock et al. | |
| 6,025,034 A | | 2/2000 | Strutt et al. | |
| 6,193,831 B1 | | 2/2001 | Overcash et al. | |
| 6,296,910 B1 | | 10/2001 | Choy et al. | |
| 6,391,408 B1 | | 5/2002 | Hutchinson | |
| 6,416,817 B1 | | 7/2002 | Rangwalla et al. | |
| 6,645,569 B2 | * | 11/2003 | Cramer et al. | 427/466 |
| 2002/0005145 A1 | | 1/2002 | Sherman | |
| 2002/0045010 A1 | | 4/2002 | Rohrbaugh et al. | |
| 2002/0114933 A1 | | 8/2002 | Gould | |
| 2002/0164464 A1 | | 11/2002 | Monie | |

FOREIGN PATENT DOCUMENTS

| | | | |
|---|---|---|---|
| EP | 0 513 452 | | 11/1992 |
| EP | 0 590 263 | | 4/1994 |
| EP | 0 655 346 | | 5/1995 |
| EP | 0 759 365 | | 2/1997 |
| JP | 53-000790 B | * | 1/1978 |
| JP | 55-051583 | * | 4/1980 |
| WO | WO 98/50482 | | 11/1998 |
| WO | WO 02/40579 | * | 5/2002 |
| WO | WO 03/078734 | | 9/2003 |

OTHER PUBLICATIONS

Krook et al, Euruopean Polymers, Films, Laminations and Extrusion Coatings Conference, 8th, Barcelona Spain, May 2001, pp 171–176.*

* cited by examiner

*Primary Examiner*—Erma Cameron
(74) *Attorney, Agent, or Firm*—Flynn, Thiel, Boutell & Tanis, P.C.

(57) ABSTRACT

A nanoparticle barrier-coated substrate is prepared by mixing pigment nanoparticles, a binder and a liquid carrier to form a coating solution, applying the coating solution onto the substrate and drying the coating solution to form the barrier coating on the substrate. The pigment nanoparticles can be chosen from talc, calcium carbonate, clay, silica and plastic and the substrate can be a cellulosic material or an inorganic material. If the substrate is initially provided with large pores, a precoating can be applied to the substrate prior to the application of the pigment nanoparticles thereto.

15 Claims, 7 Drawing Sheets

NANOPARTICLE BARRIER-COATED SUBSTRATE AND METHOD FOR MAKING THE SAME

BACKGROUND OF THE INVENTION

Barrier coatings are coatings that are applied to a substrate to provide barrier properties thereto by reducing or eliminating the porosity thereof. Typical substrates which are provided with barrier coatings are cellulosic substrates, plastic substrates and substrates made of inorganic material.

With respect to cellulosic substrates, fluorochemicals are currently being used to provide barrier properties to paper. The fluorochemicals are used to provide oil and grease resistance to papers and boards used in the food industry, such as pizza boxes and in the packaging of pet food. However, fluorochemicals have problems in that they are expensive and certain products have been found to bioaccumulate in the environment.

Additional conventional types of barrier coatings applied to paper products include waxes and synthetic plastic films. Although waxes confer excellent barrier properties to a paper substrate, they must be applied off-line at relatively high coating weights and cannot be glued or over-printed very easily. The plastic films also confer good barrier properties but are expensive and typically difficult to use. They also have problems with respect to recyclability and bio-degradability of the paper substrates.

Barrier coatings are also applied to plastic substrates which are used in pharmaceutical and food packaging. U.S. Pat. No. 6,416,817 to Rangwalla et al discloses a process for preparing an oxygen barrier coating in which coatings of selected moisture-cured disilylated secondary amines are applied to a plastic material. This reference additionally discloses that a nanoparticulate filler can be contained in the coating in order to reduce the thickness and/or weight thereof.

U.S. Pat. No. 6,391,408 to Hutchinson discloses polyester articles having a coating applied to at least one of the surfaces thereof in order to improve the gas-barrier characteristics of the article. The polyester material is preferably polyethylene terephthalate and the preferred barrier coating materials include poly(hydroxyaminoethers). This reference further discloses that nanoparticles can enhance the barrier properties of the film by plugging the holes in the polymer matrix and thus discourage gases from passing therethrough or creating a more tortuous path for gas molecules to take as they permeate through the barrier coating.

U.S. Pat. No. 6,193,831 to Overcash et al discloses a coated sheet material made by coating a porous substrate sheet material with a barrier coating composition comprising a cross-linkable polymer which is resistant to penetration by water moisture and a water-dispersible film-forming polymer that is resistant to penetration by grease and oil. The coated sheet material is used in forming articles and food wrappers for use in conventional or microwave ovens. The barrier coating can also include fillers, such as clays, pigments, such as titanium dioxide, food coloring dyes and suspending or dispersing agents. The substrates in this reference can include non-woven and woven polymers, porous clays and cellulose-based materials.

As discussed above, there is a particular interest in providing improved barrier resistance for paper products due to their wide utilization in commerce. However, even though these paper products are generally light in weight, durable, economical, recyclable and biodegradable, they have shortcomings such as oils and greases leaving stains thereon, humidity and moisture weakening its strength, the adherence of many foodstuffs thereto and its ease of damage by water. In order to solve these problems, protective barrier coatings have been applied to the paper products.

Accordingly, there is a need for a barrier-coated substrate which is easy and inexpensive to manufacture, has good barrier properties with respect to water, oil and grease resistance and can be easily disposed of or recycled.

SUMMARY OF THE INVENTION

One embodiment of the present invention is directed to a method of providing a barrier coating on a cellulosic substrate in which pigment nanoparticles, a binder and a liquid carrier are mixed to form a coating solution, the coating solution applied onto the cellulosic substrate and dried to form the barrier coating on the substrate.

Another embodiment of the present invention is directed to an inorganic substrate having a barrier coating provided thereon through the steps of mixing pigment nanoparticles, a binder and a liquid carrier to form a coating solution, applying the coating solution onto the inorganic substrate and drying the coating solution to form the barrier coating on the substrate.

Yet another embodiment of the present invention is directed to a substrate having a barrier coating applied thereto by steps consisting essentially of mixing pigment nanoparticles, a binder and a liquid carrier to form a coating solution, applying the coating solution onto the substrate and drying the coating solution to form the barrier coating on the substrate.

The barrier-coated substrate of the present invention is easy to manufacture, environmentally safe, can be recycled and has unexpectedly good barrier properties.

DETAILED DESCRIPTION

Figure 1:
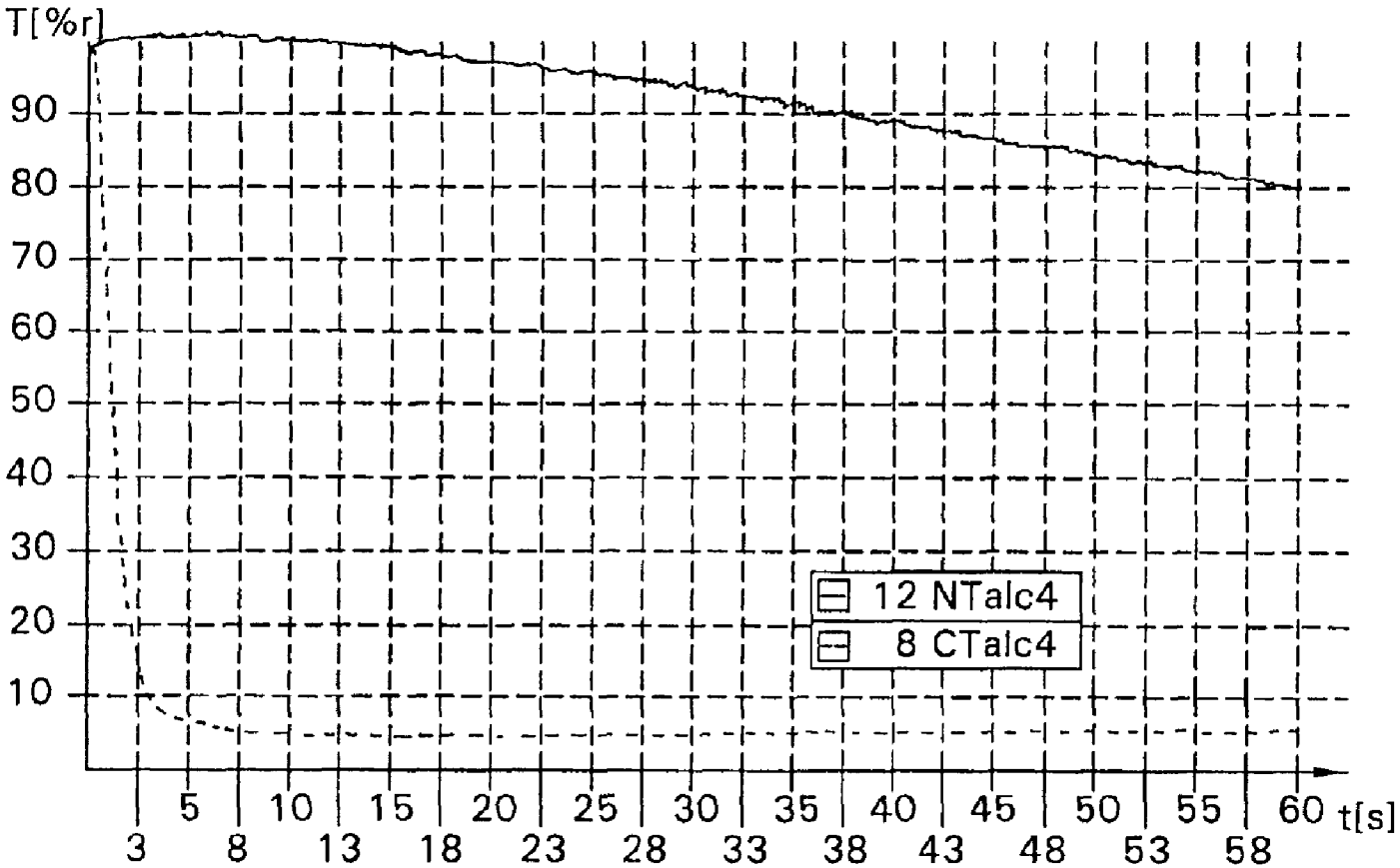
FIG. 1 is a graph illustrating the water barrier properties of a barrier-coated substrate according to the present invention and a comparative barrier-coated substrate.

The present invention is based on the discovery that a coating solution containing nanoparticle pigments can effectively provide a barrier coating on a variety of different substrates. The nanoparticles used in the present invention can have a size of from 1-400 nanometers and preferably have an average particle size of approximately 50 nanometers. The material of the nanoparticles can be selected based on the intended use of the barrier-coated substrate.

Examples of materials suitable for use as the pigment nanoparticles of the present invention are talc, calcium carbonate, clay, silica, alumina, and plastics. The nanoparticles can be provided as inorganic oxides, silicates, carbonates and hydroxides. The clay materials suitable for use in the present invention include smectites, kaolins, illites, chlorites, attapulgites, and mixed clays thereof. Examples of plastic materials suitable for use as the nanoparticles of the present invention include polystyrene and polyolefins. Clays, carbonates and talc are generally the most preferred materials for use in the present invention due to their wide availability and relatively inexpensiveness. The pigment nanoparticles of the present invention are generally commercially available and are not required to be manufactured in any manner that is not commonly known in the art.

The pigment nanoparticles of the present invention are used to form a coating solution which also contains a binder and a liquid carrier. The purpose of the binder in the present invention is to adhere the nanoparticle pigments firmly to the substrate surface and to each other. The pigment to binder ratio is typically in the range of from 2:1 to 10:1 and the pigment and binder can constitute the entire solids content of the coating solution. The binder can be a starch, protein or synthetic material. Synthetic binders are preferred in the present invention and can be a styrene-butadiene latex or a vinyl acetate polymeric latex, with a styrene-butadiene latex being especially preferred. If desired, secondary components can be present in the binder to help modify the properties thereof. These secondary components include acrylonitrile, methyl methacrylate, vinyl acids, hydroxyethylacrylate, ammonium zirconium carbonate, glyoxal, etc.

A liquid carrier is used in the present invention to disperse the pigment nanoparticles and the binder and preferably is water. The coating solution typically has a solids content of from about 10–30%. Other liquids can be used as the liquid carrier as long as they are compatible with the pigment nanoparticles and the binder and can be removed by a subsequent drying process. Low molecular weight organic solvents can be used in combination with water as the liquid carrier and examples thereof include alcohols such as ethanol, methanol, propanol, isopropanol and mixtures thereof.

The pigment nanoparticles, binder and liquid carrier are mixed together to form a coating solution. The mixing step can be accomplished at room temperature and is not especially critical as long as the nanoparticles are uniformly dispersed in the coating solution.

Additives such as insolubilizers, plasticizers, rheology control agents, dispersants, preservatives, defoamers and dyes can be contained in the coating composition of the present invention as long as they do not materially affect the novel barrier properties thereof.

After preparation of the above-described coating solution, it is applied to a substrate. The application of the coating solution to the substrate can be done by any typical coating method such as roll coating, blade coating, rod coating and air knife coating. Alternatively, the coating solution can be applied by either bar, gravure, dip, curtain or spray coating. The optimum coating weight can be determined based on the porosity and roughness of the substrate.

Although the present invention is particularly suitable for applying a barrier coating to a paper substrate, the present invention is not limited thereto and other porous substrates such as wood, wallboard, fiberglass, plastics, metal, glass, ceramic, stone, concrete, asphalt, and painted substrates all come within the scope of the present invention. In the case of a particularly porous substrate, a pre-coating can be applied thereto in order to reduce the porosity thereof and then the barrier coating of the present invention applied to the pre-coated substrate in order to provide a barrier coating on the substrate.

Typically, a paper substrate has a Gurley permeability of from about 3 to 2,000 seconds prior to the application of the barrier coating thereto. After application of the barrier coating thereto, the coated paper substrate has a Gurley permeability of from 8,000 to 12,000 seconds, preferably 9,000 to 12,000 seconds, and most preferably 10,000 to 12,000 seconds. The Gurley permeability test is well known to those of ordinary skill in the art and is determined by measuring the number of seconds required for 100 $cm^3$ of air to pass through one square inch of sample under a constant pressure.

After the coating solution of the present invention is applied onto the substrate, it is dried to form the barrier coating thereon. When the substrate is paper, the preferred methods of drying the coating on the substrate are, but not limited to, hot air impingement and infra-red drying, and a combination thereof. After drying, calendering is preferably performed on the coated paper substrate as a final finishing step. When other types of substrates are used in the present invention, the manner of drying the coating solution on the substrate is not critical and can be any conventionally used and known drying method for the particular substrate.

The present invention is further explained but not limited by the following Examples.

In the following Examples, talc was used as the pigment nanoparticles and commercial talc was used as comparison particles. The characteristics of the talc used in the Examples are shown below in Table 1.

TABLE 1

Characterization of Pigments

| Pigment | BET Data | | Particle Size | |
|---|---|---|---|---|
| Nano-talc | | | Average Particle Diameter | 100 nm |
| | Surface area | 249.90 $m^2/g$ | Volume | 588.3 nm |
| | Micropore area | 65.52 $m^2/g$ | Intermediate | 468.0 nm |
| | Micropore volume | $2.83 \times 10^{-2}$ $cm^3/g$ | Numbered | 108 nm |
| | BJH Adsorption Average Pore diameter | 6.77 nm | | |
| Commercial Talc | | | Average Particle Diameter | 1.5 $\mu m$ |
| | Surface area | 7.83 $m^2/g$ | Volume | 10334.6 nm |
| | Micropore area | 0 | Intermediate | 4024 nm |
| | Micropore | 0 | Num- | 863.3 nm |

TABLE 1-continued

Characterization of Pigments

| Pigment | BET Data | | Particle Size |
|---|---|---|---|
| | volume | | bered |
| | BJH | 22.62 | |
| | Adsorption | | |
| | Average | | |
| | Pore | | |
| | Diameter | | |

Six different coatings, three each for nanotalc and three each for conventional talc, were prepared with the same binder, styrene butadiene, at three different pigment to binder ratios. The coating formulations are as follows, with the pigments and binders being expressed in units of total parts.

NT—Nanotalc; CT—Commercial Talc; NT/CT LP—Calendered at 1000 phi and 20° C. NT/CT H—Calendered at 1800 pli and 20° C.; NT/CT HT—Calendered at 1800 pli and 60° C.

TABLE 2

Coating Composition, Units of Total Parts

| Coating Designation | Nano Talc | Commercial Talc | SBR |
|---|---|---|---|
| NT2 | 100 | 0 | 10 |
| NT3 | 100 | 0 | 25 |
| NT4 | 100 | 0 | 50 |
| CT2 | 0 | 100 | 10 |
| CT3 | 0 | 100 | 25 |
| CT4 | 0 | 100 | 50 |

These coating formulations were used to coat paper sheets with Meyer rods to obtain uniform coat weights. The base sheet was a bleached, 60% hardwood/40% softwood sheet. The basis weight was 54.37 g/m$^2$, refined to 380 mls CSF. The size of the SBR particles was 200–250 nm.

TABLE 3

Properties of the Coatings

| Coating Pigment | Coat weight, g/m$^2$ | pH | Solids, % | Brookfield Viscosity, cp |
|---|---|---|---|---|
| NT2 | 6.65 | 8.34 | 19.3 | 950 |
| NT3 | 6.73 | 8.37 | 19.5 | 1150 |
| NT4 | 6.66 | 8.41 | 19.5 | 1180 |
| CT2 | 7.04 | 8.14 | 19.8 | 264 |
| CT3 | 7.40 | 8.11 | 20.1 | 271 |
| CT4 | 7.73 | 8.16 | 20.1 | 275 |

These six paper samples and the calendered samples were all subjected to the following tests to analyze their pore structure, grease resistance, and resistance to penetration of water and organic fluids.

EXAMPLE 1

Analysis of Pore Structure by Mercury Intrusion Porosimetry

The pore structure of the samples was analyzed using a Micromeritics Mercury Intrusion Porosimeter, Model Auto Pore 9220. The data were then analyzed using the Autopore software to determine the tortuosity and the permeability of each sheet.

TABLE 4

Mercury Intrusion Porosimetry

| Coating | Median Pore Dia (V), nm | Average Pore Dia, nm | Tortuosity, Dimensionless | Permeability, mdarcy |
|---|---|---|---|---|
| Base Sheet | 47501.4 | 33991.8 | 12.8092 | 189.82 |
| NT2 | 21994.5 | 605.3 | 3.4351 | 1756.40 |
| NT3 | 30126.4 | 26037.3 | 4.1634 | 1708.51 |
| NT4 | 24207.6 | 243.8 | 3.6534 | 1501.73 |
| CT2 | 30762.3 | 11015.5 | 2.014 | 1230.00 |
| CT3 | 30177.9 | 14786.4 | 3.5727 | 1982.39 |
| CT4 | 35165.0 | 11259.6 | 3.5056 | 2214.11 |
| CT2L | 54606.4 | 3516.2 | 7.3322 | 355.04 |
| CT2H | 55918.1 | 3594.4 | 4.0845 | 1059.64 |
| CT2HT | 57197.4 | 41693.1 | 11.9154 | 148.83 |
| CT4L | 54416.0 | 3698.8 | 4.0249 | 1166.44 |

EXAMPLE 2

TAPPI Test T 559 pm—96 (3M Kit Test)

This method describes a procedure for testing the degree of repellency or the antiwicking characteristics of paper. The testing was done on sample with a series of numbered reagents, prepared according to Table 5.

TABLE 5

Mixtures of Reagents for Preparing KIT's Solutions

| Kit No | Castor Oil, (g) | Toluene (ml) | n-Heptane (ml) |
|---|---|---|---|
| 1 | 969.0 | 0 | 0 |
| 2 | 872.1 | 50 | 50 |
| 3 | 775.2 | 100 | 100 |
| 4 | 678.3 | 150 | 150 |
| 5 | 581.4 | 200 | 200 |
| 6 | 484.5 | 250 | 250 |
| 7 | 387.6 | 300 | 300 |
| 8 | 290.7 | 350 | 350 |
| 9 | 193.8 | 400 | 400 |
| 10 | 96.9 | 450 | 450 |
| 11 | 0 | 500 | 500 |
| 12 | 0 | 550 | 550 |

The solution test is performed by applying an intermediate kit number solution; a drop of which is released onto the surface of the test paper. After 15 seconds, the excess test solution is removed using a clean tissue and the test area is examined. Darkening of the test sample denotes a failure. If a specimen fails, the same test is repeated for the specimen using a lower numbered kit solution. The procedure is repeated until the lowest numbered kit solution rests on the surface of the sample specimen without causing a failure.

TABLE 6

3M Kit Test Results

| Coating | KIT 1 | KIT 2 | KIT 3 | KIT 4 |
|---|---|---|---|---|
| Base Sheet | Failed | Failed | Failed | Failed |
| NT2 | Passed | Passed | Failed | Failed |
| NT3 | Passed | Passed | Failed | Failed |
| NT4 | Passed | Passed | Failed | Failed |
| CT2 | Failed | Failed | Failed | Failed |
| CT3 | Failed | Failed | Failed | Failed |
| CT4 | Failed | Failed | Failed | Failed |
| CT2L | Failed | Failed | Failed | Failed |
| CT3H | Failed | Failed | Failed | Failed |
| CT2HT | Failed | Failed | Failed | Failed |
| CT4L | Failed | Failed | Failed | Failed |

TABLE 6-continued

| 3M Kit Test Results | | | | |
|---|---|---|---|---|
| Coating | KIT 1 | KIT 2 | KIT 3 | KIT 4 |
| CT4H | Failed | Failed | Failed | Failed |
| CT4HT | Failed | Failed | Failed | Failed |
| NT2L | Passed | Passed | Failed | Failed |
| NT2H | Passed | Passed | Failed | Failed |
| NT2HT | Passed | Passed | Failed | Failed |
| NT4L | Passed | Passed | Failed | Failed |
| NT4H | Passed | Passed | Failed | Failed |
| NT4HT | Passed | Passed | Failed | Failed |

From the above results, one can clearly see that only the nanotalc-containing coatings passed with Kit No 2 solution, which has a greater percentage of castor oil and equal amounts of toluene and n-heptane, clearly indicating that nanotalc-based coatings act as better barrier coatings than the commercial talc containing coatings to oil.

EXAMPLE 3

Dynamic Penetration Measurement by EMCO DPM 30

Figure 2:
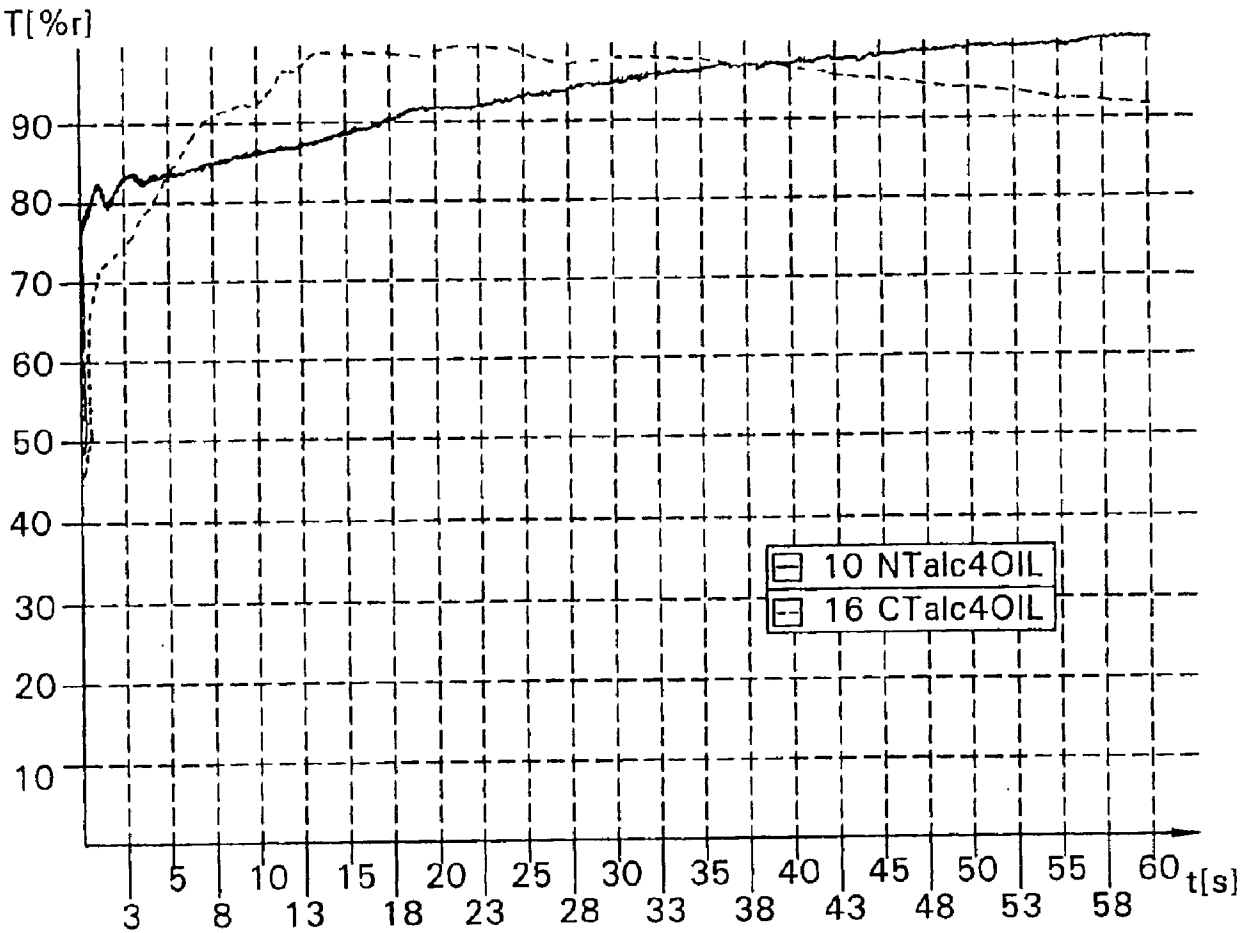
FIG. 2 is a graph illustrating the oil barrier properties of a barrier-coated substrate according to the present invention and a comparative barrier-coated substrate.
Figure 3:
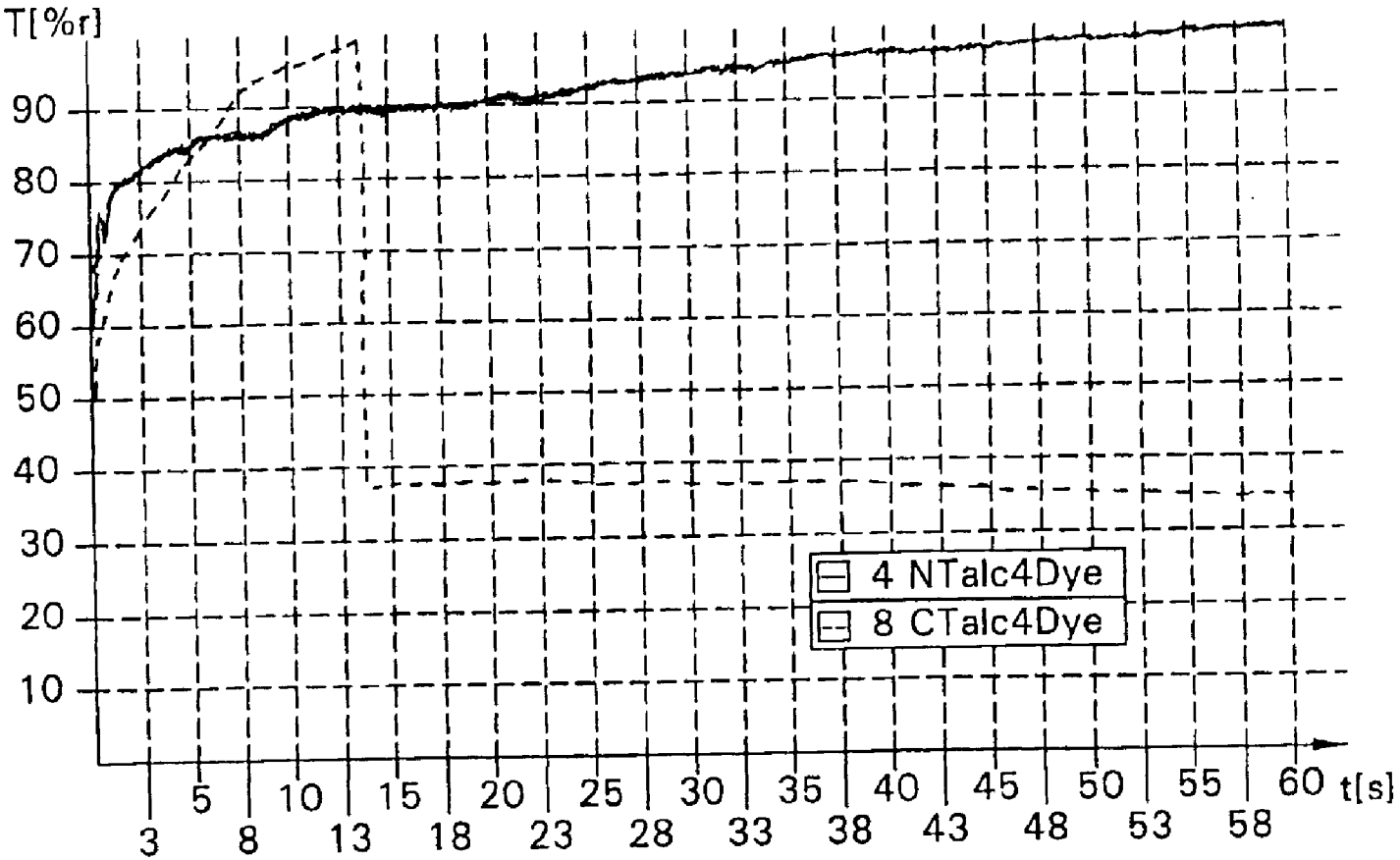
FIG. 3 is a graph illustrating the dye solution barrier properties of a barrier-coated substrate according to the present invention and a comparative barrier-coated substrate.
Figure 4:
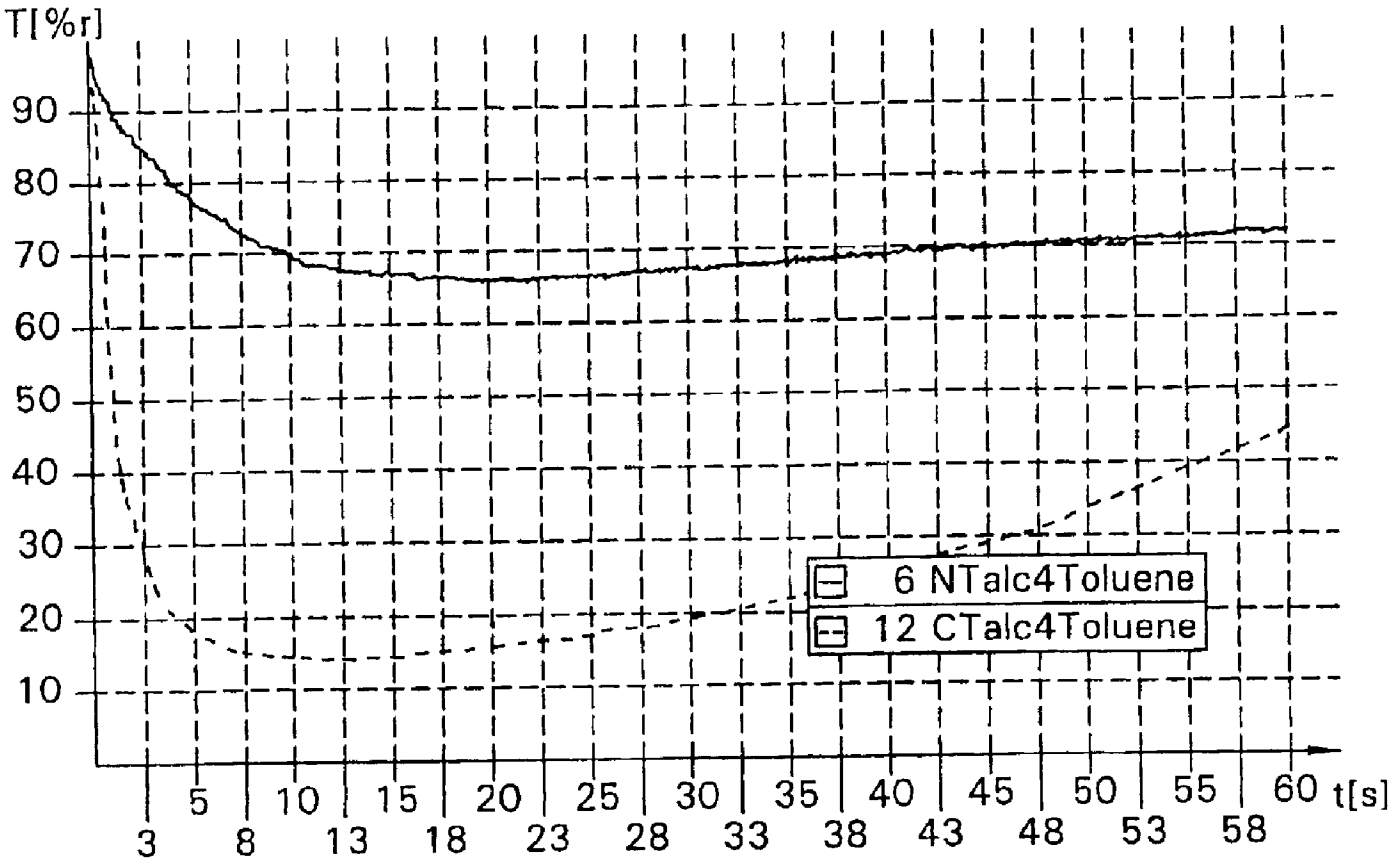
FIG. 4 is a graph illustrating the toluene-barrier properties of a barrier-coated substrate according to the present invention and a comparative barrier-coated substrate.
Figure 5:
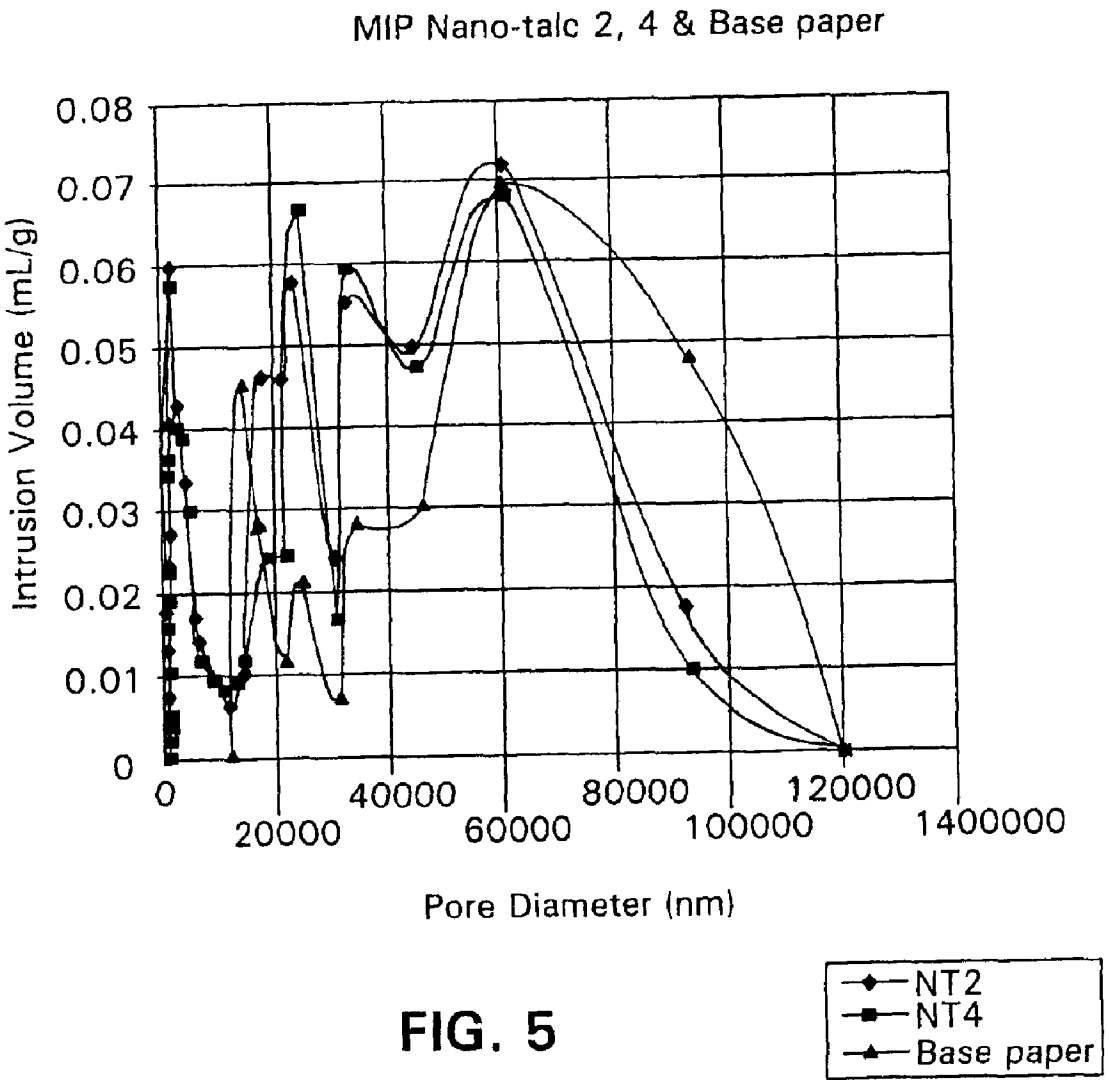
FIG. 5 is a graph illustrating the intrusion volume versus pore diameter of a barrier-coated substrate according to the present invention compared with a comparative barrier-coated substrate.
Figure 6:
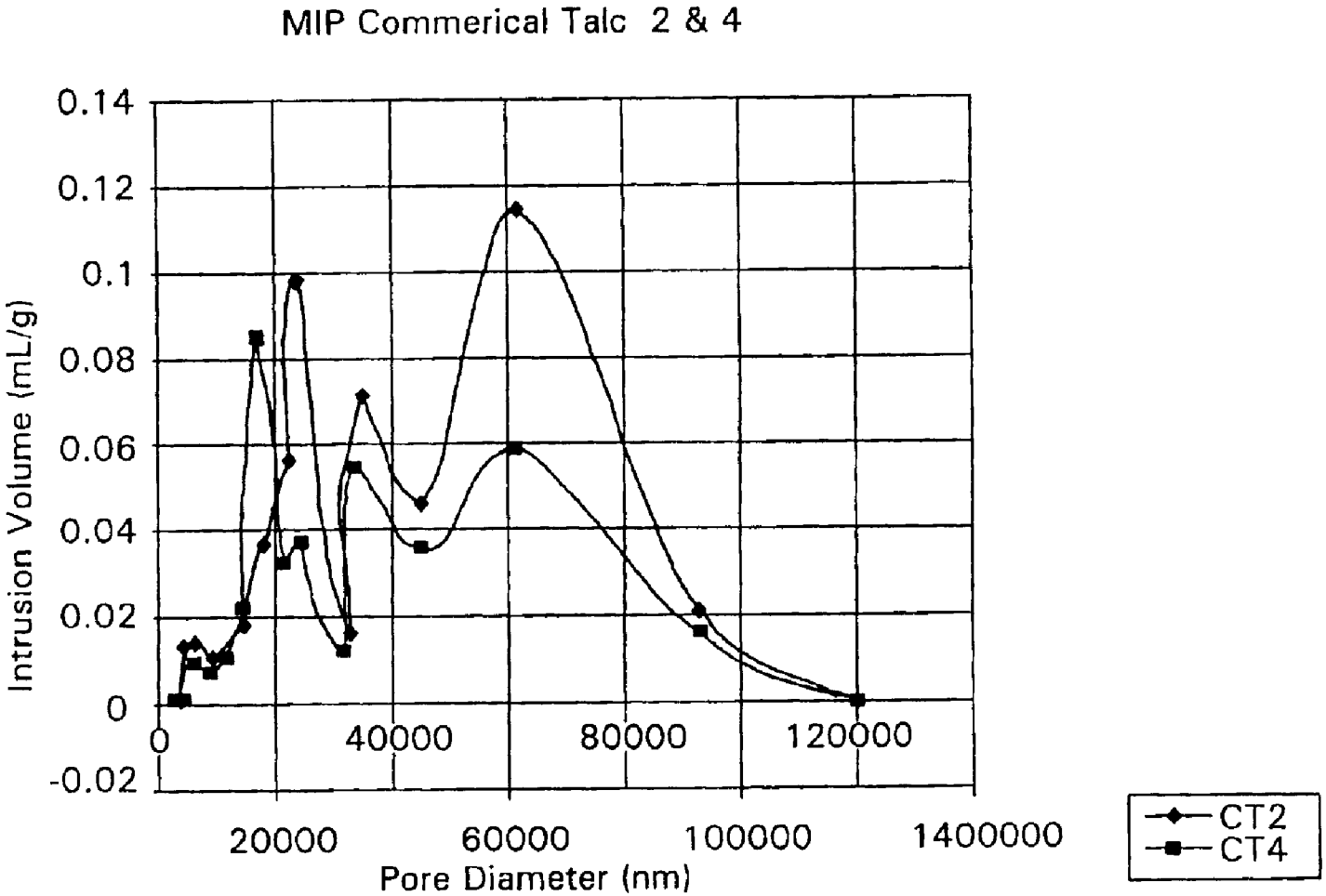
FIG. 6 is a graph illustrating the intrusion volume versus pore diameter for two different comparative barrier-coated substrates.
Figure 7:
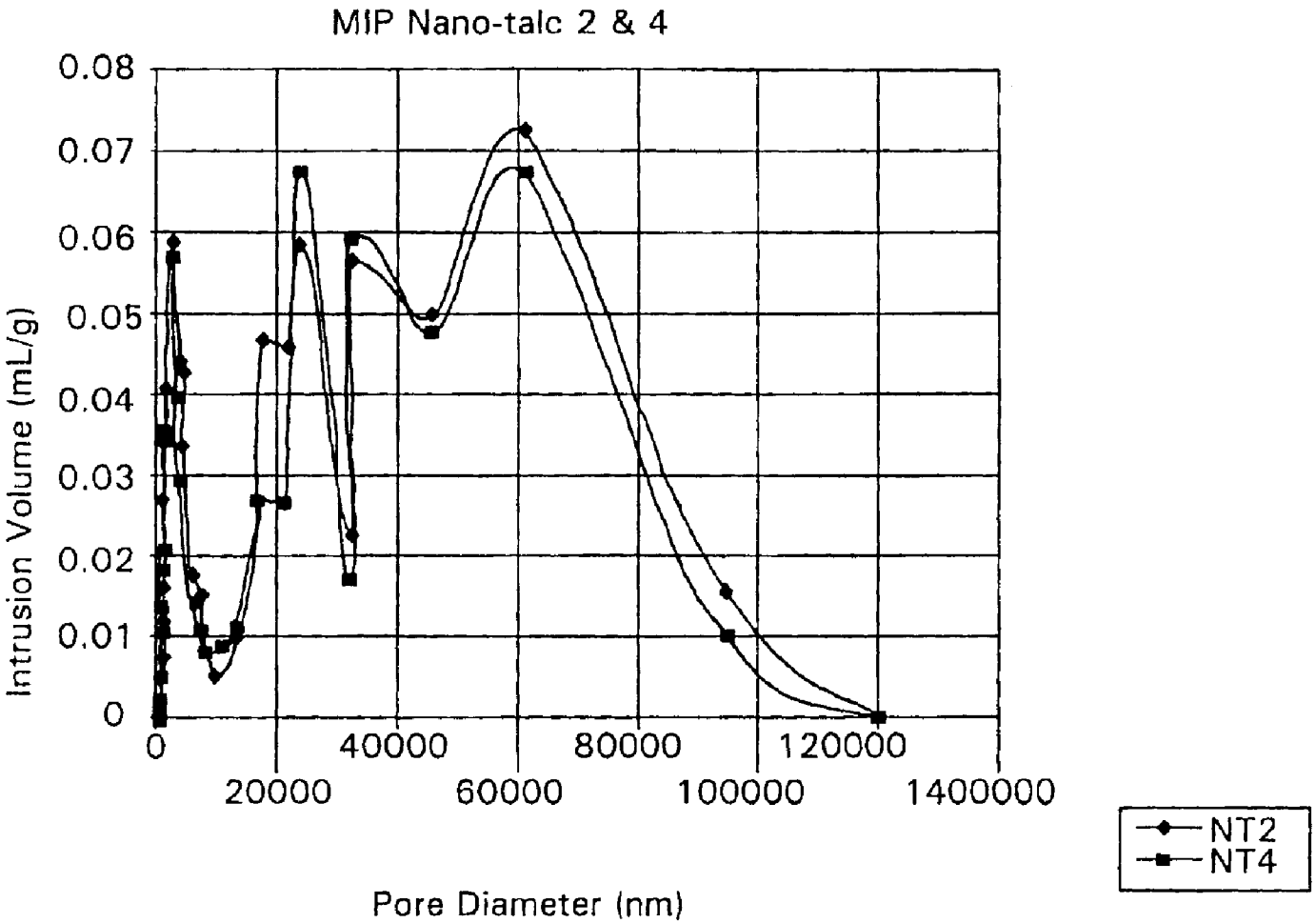
FIG. 7 is a graph illustrating the intrusion volume versus pore diameter for two barrier-coated substrates according to the present invention.

All the coated samples were tested for penetration of fluids using an EMCO DPM 30 apparatus. The fluids used in this test include water, vegetable oil, red dye, and toluene. The results from this measurement are shown in FIGS. 1–7.

EXAMPLE 4

Ralston-Purina Test

The purpose of this test is to determine the amount of oil penetration through a sample under time and temperature controlled conditions. A printed grid is placed under a 4×4 inch sample and both are placed on a metal plate. A metal ring is also placed on the sample and 5 g of sand is poured into the center of the ring. About 1.3 ml of red dyed synthetic oil provided by Ralston-Purina is added to the sand pile, causing it to become saturated with the test oil. The samples are then placed in an oven at 140° F. The sample is removed every four hours and examined for stains. Each square on the grid is one percent. For a good resistance, the number of stains on the grid should be less than 2% (less than 2 squares on the grid).

TABLE 7

| Ralston-Purina Test Data | | | |
|---|---|---|---|
| Coating | 4 Hours | 8 Hours | 12 Hours |
| Base Sheet | Failed | Failed | Failed |
| NT2 | Passed | Passed | Failed |
| NT3 | Passed | Passed | Failed |
| NT4 | Passed | Passed | Failed |
| CT2 | Failed | Failed | Failed |
| CT3 | Failed | Failed | Failed |
| CT4 | Failed | Failed | Failed |
| CT2L | Failed | Failed | Failed |
| CT2H | Failed | Failed | Failed |
| CT2HT | Failed | Failed | Failed |
| CT4L | Failed | Failed | Failed |
| CT4H | Failed | Failed | Failed |
| CT4HT | Failed | Failed | Failed |
| NT2L | Passed | Passed | Failed |
| NT2H | Passed | Passed | Failed |
| NT2HT | Passed | Passed | Failed |
| NT4L | Passed | Passed | Failed |
| NT4H | Passed | Passed | Failed |
| NT4HT | Passed | Passed | Failed |

From the above results, one can see that only the nanotaic containing coatings passed the 8-hour test, indicating that the nanotalc containing coatings act as better oil resistant barrier coatings.

Although the present invention has been described in terms of certain preferred embodiments, in certain exemplary methods, it is understood that the scope of the invention is not to be limited thereby.

What is claimed is:

1. A method of providing a barrier coating on a cellulosic substrate comprising the steps of:

mixing pigment nanoparticles, a binder and a liquid carrier to form a coating solution;

applying the coating solution onto the cellulosic substrate; and drying the coating solution to form the barrier coating on the substrate wherein the cellulosic substrate has a Gurley permeability of from 3–2,000 seconds prior to the application of the coating solution and a Gurley permeability of from 8,000–12,000 seconds after the barrier coating is formed thereon.

2. The method of claim 1, wherein the pigment nanoparticles are selected from the group consisting of talc, calcium carbonate, clay, silica and a plastic.

3. The method of claim 1, wherein the liquid carrier is water.

4. The method of claim 1, wherein the pigment nanoparticles have an average particle size of 0.1 $\mu$m.

5. The method of claim 1, wherein the cellulosic substrate is paper.

6. The method of claim 1, wherein said coating solution consists essentially of the pigment nanoparticles, binder and liquid carrier.

7. A method of providing a barrier coating on a substrate consisting essentially of the steps of:

mixing pigment nanoparticles, a binder and a liquid carrier to form a coating solution;

applying the coating solution onto the substrate; and drying the coating solution to form the barrier coating on the substrate wherein the cellulosic substrate has a Gurley permeability of from 3–2,000 seconds prior to the application of the coating solution and a Gurley permeability of from 8,000–12,000 seconds after the barrier coating is formed thereon.

8. The method of claim 7, wherein the pigment nanoparticles are selected from the group consisting of talc, calcium carbonate, clay, silica and a plastic.

9. The method of claim 7, wherein the liquid carrier is water.

10. The method of claim 7, wherein the pigment nanoparticles have an average particle size of 0.1 $\mu$m.

11. The method of claim 7, wherein said coating solutions consist essentially of the pigment nanoparticles, binder and liquid carrier.

12. The method of claim 7, wherein said substrate is paper.

13. A method of providing a barrier coating on a cellulosic substrate comprising the steps of:

mixing pigment nanoparticles, a styrene-butadiene latex binder and a liquid carrier to form a coating solution;

applying the coating solution onto the cellulosic substrate; and drying the coating solution to form the barrier coating on the substrate.

14. A method of providing a barrier coating on a cellulosic substrate comprising the steps of:

mixing pigment nanoparticles, a binder and a liquid carrier to form a coating solution;

applying the coating solution onto the cellulosic substrate;

drying the coating solution to form the barrier coating on the substrate; and calendaring the coated substrate.

15. A method of providing a barrier coating on a cellulosic substrate comprising the steps of:

precoating the cellulosic substrate to reduce the porosity thereof;

mixing pigment nanoparticles, a binder and a liquid carrier to form a coating solution;

applying the coating solution onto the precoated cellulosic substrate; and drying the coating solution to form the barrier coating onto the precoated cellulosic substrate.

* * * * *